US005102756A

United States Patent [19]

Vincett et al.

[11] Patent Number: 5,102,756

[45] Date of Patent: Apr. 7, 1992

[54] CAMERA SPEED PRINTING PLATE WITH IN SITU MASK

[75] Inventors: Paul S. Vincett, Grand Valley; Rafik O. Loutfy, Willowdale; Gregory J. Kovacs; Man C. Tam, both of Mississauga; Ronald Forstinger, St. Catherines; Brian D. Lesser, Willowdale; Arnold L. Pundsack, Georgetown; Christopher Rodgers, Toronto; Philip H. Soden, Oakville, all of Canada

[73] Assignee: Xerox Corporation, Stamford, Conn.

[21] Appl. No.: 636,172

[22] Filed: Dec. 31, 1990

[51] Int. Cl.[5] ..... G03G 13/22

[52] U.S. Cl. ..... 430/41; 430/67; 430/96

[58] Field of Search ..... 430/41, 67, 96

[56] References Cited

U.S. PATENT DOCUMENTS

| | | | |
|---|---|---|---|
| 3,648,607 | 3/1972 | Gundlach | 101/450 |
| 3,820,984 | 6/1974 | Gundlach | 96/1 PS |
| 4,230,782 | 10/1981 | Goffe | 430/41 |
| 4,518,668 | 5/1985 | Nakayama | 430/49 |
| 4,532,197 | 7/1985 | Humberstone et al. | 430/41 |
| 4,761,443 | 8/1988 | Lopes | 524/110 |
| 4,762,764 | 8/1988 | Ng et al. | 430/115 |
| 4,937,163 | 6/1990 | Tam et al. | |

OTHER PUBLICATIONS

Journal of Imaging Technology, vol. 10, No. 5, Oct. 1984, "Applications of Xerox Dry Micro Film (XDM), a Camera-Speed, High Resolution Nonsilver Film with Instant, Dry Development", A. L. Pundsack et al., pp. 190 to 196.

*Primary Examiner*—Marion E. McCamish
*Assistant Examiner*—S. Rosasco
*Attorney, Agent, or Firm*—Judith L. Byorick

[57] ABSTRACT

Disclosed is a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

15 Claims, 2 Drawing Sheets

CAMERA SPEED PRINTING PLATE WITH IN SITU MASK

BACKGROUND OF THE INVENTION

The present invention is directed to a printing plate precursor and to a process for preparing a printing plate. More specifically, the present invention is directed to a printing plate precursor comprising a base layer, a layer of photohardenable material, and a layer of softenable material containing photosensitive migration marking particles. In one embodiment of the present invention, a printing plate is prepared by electrically charging the precursor and then exposing the precursor to light in an imagewise pattern. After exposure, the softenable material is made to soften, thereby enabling the migration marking particles that had been exposed to light to migrate through the softenable material toward the base layer and resulting in the layer of softenable material becoming transmissive to light in areas where the migration marking particles have migrated toward the base layer. Subsequently, the precursor is uniformly exposed to light, thereby causing areas of the photohardenable material to harden in areas situated contiguous with light-transmissive areas of the softenable layer. Thereafter, the precursor is exposed to a solvent in which the softenable material and photohardenable material in its unhardened form are either soluble or are softened sufficiently to enable their removal from the base layer by wiping or brushing, and in which photohardenable material in its hardened form is not soluble, thereby removing from the base layer all materials except for the hardened photohardenable material, which remains on the base layer in imagewise pattern. Alternatively, if desired, the plate can subsequently be exposed to an etchant that etches the base material in areas not covered by the photohardenable material, followed by removal of the hardened photohardenable material from the base layer, leaving the base layer etched in an imagewise pattern. This etching process is often used for processing lithographic printing plates of the deep-etch or bimetallic type, as disclosed in, for example, *The Lithographer's Manual,* 7th Ed., R. N. Blair, ed., Graphic Arts Technical Foundation, Pittsburgh (1983), the disclosure of which is totally incorporated herein by reference.

In conventional lithographic printing processes, printing plates are frequently prepared by first forming on conventional silver halide film an image corresponding in size to the desired size of the images to be generated, generally by photographing a paste-up of the desired image. Subsequent to development of the silver halide film, the film is transmissive to light in some areas and absorbing to light in other areas in an imagewise pattern. A printing plate precursor, which typically comprises a base layer and a layer of photohardenable material, such as a diazo compound or diazo sensitizer in an organic colloid or synthesized polymer, or a polymer that becomes crosslinked upon exposure to light, is then placed in contact with the developed silver halide film, and light, generally within the ultraviolet wavelength range, is directed onto the silver halide film. The light passes through the silver halide film mask to the photohardenable material in areas of the film that are transmissive to light, and the photohardenable material exposed to light becomes hardened while unexposed areas of the photohardenable material remain unhardened. Subsequently, the precursor is exposed to a solvent in which the hardened form of the photohardenable material is insoluble and the unhardened form of the photohardenable material is soluble, thus washing away the unhardened material and leaving the hardened material on the base layer in a pattern corresponding to the desired image. The hardened photohardenable material is typically hydrophobic, while the base layer is generally hydrophilic, although the base layer can be selected to be hydrophobic and the hardened photopolymeric material can be selected to be hydrophilic. Thus, when the printing plate thus formed is contacted with an oil-based ink, the ink remains on portions of the plate containing the hardened photohardenable material but is repelled by the base plate material. Contacting the plate with an ink and then contacting the inked plate with a printing substrate thus generates prints of the desired image. Alternatively, the ink image on the plate can be applied to an offset roller and the ink on the offset roller subsequently applied to the printing substrate. Further, instead of using a photohardenable material on the base plate, a hydrophobic photodegradable material can be used in which the exposed areas can be removed on development. Plate coatings of the type described are generally negative working in that the light exposed areas become photohardened and ink receptive and form the image areas. The plate coatings, however, can also be positive working. In this instance, the exposed areas are photodegraded and washed away on development and become the hydrophilic or nonimage areas of the plate. The unexposed areas remain after development and require fixing to render them light insensitive. These areas generally are hydrophobic and ink receptive and hence form the image areas.

These known processes have the disadvantage that generation of the desired image on silver halide film prior to exposing the printing plate results in added expense and processing times for printing processes wherein formation of a silver halide image is not otherwise necessary or desirable, such as digital pagination systems wherein the image is computer generated. Accordingly, a printing plate precursor that can be exposed directly by, for example, a scanning laser driven by a digital page file, would exhibit advantages such as convenience, rapid processing time, and lower cost. While it may be possible to expose a conventional printing plate by such a process, the exposure generally would require very high power lasers, which tend to be expensive and short-lived. Further, while it may be possible to employ conventional argon ion or helium-cadmium lasers to expose a printing plate comprising a series of photographic type silver halide emulsions on a paper base, these plates are often short-lived during the printing process. One type of direct imaging plate is described in *The Lithographer's Manual*, 7th Ed., R. N. Blair, ed., page 10:28, Graphic Arts Technical Foundation, Pittsburgh (1983). Because there is only a small difference between the ink and water receptivity of the image and nonimage areas on this type of plate, it is difficult to achieve optimal conditions with respect to exposure, processing, and printing on a press. With considerable care, acceptable results can be obtained as long as the contrast range of the copy is not too great; it is difficult to mix line, halftone, and solid areas on one plate, as each requires different levels of exposure or different inks for optimum printing results. Thus, a printing plate having the printing characteristics of a conventional printing plate but capable of camera speed exposure for the initial exposure is particularly desirable and is provided by the present invention.

U.S. Pat. No. 4,532,197 (Humberstone et al.) discloses a method of forming an image on an electrophotographic film material. The process entails a contact printing technique and comprises placing an image-bearing master in contact with the film, exposing the film to light through the image-bearing master, the exposure being substantially greater than the minimum necessary to render conductive the photoconductive layer of the electrophotographic film, applying a substantially uniform charge to the surface of the film in the dark immediately after exposure, leaving the film in the dark for a short time so as to allow the charge to migrate selectively, and then developing the image.

Further, U.S. Pat. No. 4,230,782 (Goffe), the disclosure of which is totally incorporated herein by reference, discloses a migration imaging system wherein an imaging member comprising migration marking material contained in or contacting a softenable layer on a supporting substrate has a latent image formed thereon, and the imaging member is subsequently developed by passing it through one or more small meniscuses bonding at least in part a volume of liquid which is capable of changing the resistance of the softenable material, to enable the migration marking material to migrate toward the substrate. Alternately, an imaged migration imaging member having marking material in a migrated image configuration and in a background configuration, which is at least in part spaced apart in depth in the softenable layer from the image configuration, is further developed by this system to enhance image quality.

In addition, U.S. Pat. No. 4,762,764 (Ng et al.) discloses a liquid developer suitable for developing electrostatic latent images either on dielectric paper or on an electroreceptor or photoreceptor substrate. In Examples 1, 3, and 6 to 10 of the patent, the liquid developer is used to develop images on a migration imaging member.

"Applications of Xerox Dry Microfilm (XDM), a Camera-Speed, High Resolution, Nonsilver Film with Instant, Dry Development," A. L. Pundsack, P. S. Vincett, P. H. Soden, M. C. Tam, G. J. Kovacs, and D. S. Ng, *Journal of Imaging Technology*, vol. 10, no. 5, pages 190 to 196 (October 1984), the disclosure of which is totally incorporated herein by reference, discloses migration imaging members and the imaging steps associated therewith. This article also discloses the use of a migration imaging member instead of silver halide film as a film intermediate in the formation of printing plates. In addition, this article proposes a printing plate comprising a substrate and a migration imaging member, wherein an electrostatic toning process is employed to create the required ink-attracting properties in the image areas and ink repelling properties in the nonimage areas. Since the softenable matrix polymer is generally hydrophobic, the toner should be hydrophilic. The toner can be fused to the matrix polymer surface to form the printing plate. In contrast to the printing processes described in this article, the present invention entails exposing to light a conventional printing plate with an in-situ mask comprising a migration imaging layer, which layer is subsequently washed away prior to employing the exposed printing plate in printing processes, resulting in formation of a conventional printing plate.

U.S. Pat. No. 3,820,984 (Gundlach) and U.S. Pat. No. 3,648,607 (Gundlach), the disclosures of each of which are totally incorporated herein by reference, discloses a migration imaging system having a migration imaging member with a binder layer of softenable material wherein a mixture of electrically photosensitive and inert fusible particles is dispersed and an imaging process wherein the fusible particles are fused, thereby fixing the migrated image of the two types of particles. The imaged member is used as a lithographic printing master.

U.S. Pat. No. 4,518,668 (Nakayama), the disclosure of which is totally incorporated herein by reference, discloses a method for preparing a lithographic printing plate by providing a light-sensitive material comprising an electroconductive support having a hydrophilic surface and a light sensitive layer and a photoconductive insulating layer thereon. The material is imagewise exposed and then subjected to electrophotographic processing to form an electrostatic latent image on the photoconductive insulating layer. After exposure, the electrostatic latent image is developed with developer particles which are opaque to the light to which the lightsensitive layer is sensitive in the presence of an electrode facing the photoconductive insulating layer. The development is carried out while applying a bias voltage between the electrode and the light-sensitive layer so that the residual charge on the non-latent areas appears zero. The exposed or unexposed areas of the light sensitive layer are then removed together with the photoconductive insulating layer, resulting in a lithographic printing plate.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the base layer or to be otherwise removed. The fracturable layer is preferably particulate in the various embodiments of the printing plate precursors. Such fracturable layers of marking material are typically contiguous to the surface of the softenable layer spaced apart from the base layer, and such fracturable layers can be substantially or wholly embedded in the softenable layer in various embodiments of the printing plate precursors.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the base layer.

The expression "optically sign-retained" as used herein is intended to mean that the dark (higher optical density) and light (lower optical density) areas of the visible image formed on the softenable layer of the printing plate precursor correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where $I$ is the transmitted light intensity and $I_o$ is the incident light intensity.

While known printing processes are suitable for their intended purposes, a need continues to exist for printing plate precursors and printing processes wherein the plate can be formed without the need for first forming an intermediate on silver halide film. In addition, there is a need for printing plate precursors and printing processes wherein the printing plate can be exposed directly by, for example, a scanning laser driven by a digital page file. Further, a need remains for printing plate precursors and printing processes that exhibit convenience, rapid processing times, and lowered cost compared to conventional printing processes employing silver halide film intermediates. There is also a need for printing plate precursors and printing processes wherein the printing plate can be exposed by a conventional laser apparatus wherein the photohardenable layer of the plate is of a conventional material and/or has the same printing characteristics of a conventional plate, such as plate life. A need also exists for printing plate precursors and printing processes wherein the imaging member and the printing plate coexist, thereby improving registration in the formation of multicolor images. When film intermediates are used to generate the image, registration is more difficult since there is an additional step where registration accuracy can be lost; in the instance of the present invention, however, there is no need to register intermediate film intermediates manually.

SUMMARY OF THE INVENTION

It is an object of the present invention to provide printing plate precursors and printing processes wherein the plate can be formed without the need for first forming an intermediate on silver halide film.

It is another object of the present invention to provide printing plate precursors and printing processes wherein the printing plate can be exposed directly by, for example, a scanning laser driven by a digital page file.

It is yet another object of the present invention to provide printing plate precursors and printing processes that exhibit convenience, rapid processing times, and lowered cost compared to conventional printing processes employing silver halide film intermediates.

It is still another object of the present invention to provide printing plate precursors and printing processes wherein the printing plate can be exposed by a conventional laser apparatus wherein the photohardenable layer of the plate is of a conventional material and/or has the same printing characteristics of a conventional plate, such as plate life.

Another object of the present invention is to provide printing plate precursors and printing processes wherein the imaging member and the printing plate coexist, thereby improving registration in the formation of multicolor images.

These and other objects of the present invention (or specific embodiments thereof) can be achieved by providing a printing plate precursor which comprises a base layer, a layer of photohardenable material, and a layer of softenable material containing photosensitive migration marking material. In another embodiment of the present invention, the printing plate precursor comprises a base layer and a layer of softenable photohardenable material containing photosensitive migration marking material. Another embodiment of the present invention is directed to a process for preparing a printing plate which comprises (a) electrically charging a printing plate precursor which comprises a base layer, a layer of photohardenable material, and a layer of softenable material containing photosensitive migration marking material; (b) exposing the precursor to incident radiation in an imagewise pattern; (c) causing the softenable material to soften, thereby enabling the migration marking material exposed to incident radiation to migrate through the softenable material toward the base layer and resulting in the layer of softenable material becoming transmissive to light in areas where the migration marking material has migrated toward the base layer and remaining nontransmissive to light in areas where the migration marking material has not migrated; (d) subsequently uniformly exposing the precursor to incident radiation, thereby causing the photohardenable material to harden in areas situated contiguous with light-transmissive areas of the softenable layer; and (e) thereafter washing the precursor with a solvent in which the softenable material and photohardenable material that has not been exposed to incident radiation are soluble and in which photohardenable material in its hardened form is not soluble, thereby removing from the base layer the softenable material and the photohardenable material not exposed to incident radiation, wherein the hardened photohardenable material remains on the base layer in imagewise configuration. Yet another embodiment of the present invention is directed to the same process except using a printing plate precursor comprising a base layer and a layer of softenable photohardenable material containing photosensitive migration marking material.

DETAILED DESCRIPTION OF THE INVENTION

Figure 1:
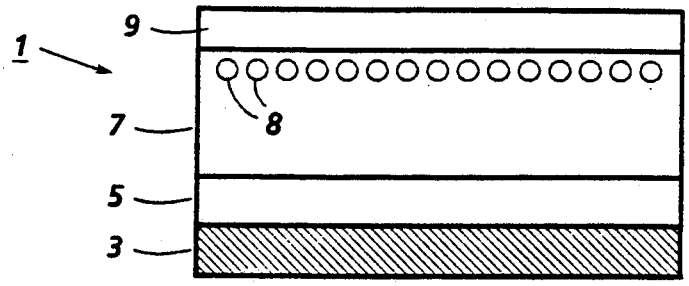
FIG. 1 illustrates schematically one embodiment of a printing plate precursor of the present invention.

Illustrated in FIG. 1 is one embodiment of a printing plate precursor of the present invention. As shown in FIG. 1, printing plate precursor 1 comprises a base layer 3, a layer comprising a photohardenable material 5 situated on base layer 3, and a layer of softenable material 7 situated on photohardenable layer 5, said softenable material containing migration marking material 8. The specific embodiment of the precursor illustrated in FIG. 1 also contains an optional overcoating layer 9. Alternatively, layer 5 can comprise a photodegradable material instead of a photohardenable material.

The base layer base layer of the printing plate precursor and the printing plate prepared and employed in the processes of the present invention is preferably of an electrically conductive material. When conductive, this layer can comprise any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like, as well as insulating materials such as paper, glass, plastic, polyesters such as Mylar® (available from E.I. Du Pont de Nemours & Company) or Melinex® 442, (available from ICI Americas, Inc.), and the like, upon which is contained a conductive coating, such as vacuum-deposited metallized plastic, including titanized or aluminized Mylar® polyester. While the base layer typically is hydrophobic, this characteristic is not necessary, and the base layer can also be hydrophilic, such as aluminum. The conductive base layer has an effective thickness, generally from about 0.25 to about 30 mils, and preferably from about 2 to about 20 mils.

Alternatively, the base layer can be of an electrically insulating material. When the base layer is insulating, the layer of softenable material is charged during the imaging process by applying charge of one polarity to the surface of the softenable migration layer and applying a charge of the opposite polarity to the base layer. Examples of suitable insulating materials include paper, glass, plastic, polyesters such as Mylar® (available from E.I. Du Pont de Nemours & Company) or Melinex® 442 (available from ICI Americas, Inc.), and the like.

Type II bimetallic plates generally have a solid copper or brass hydrophobic base layer and are electroplated on one side with chromium, which is hydrophilic, as disclosed in, for example, *The Lithographer's Manual*, 7th Ed., R. N. Blair, ed., page 10:26, Graphic Arts Technical Foundation, Pittsburgh (1983); *The Printing Industry*, V. Strauss, page 264, Printing Industries of America, in association with R. R. Bowker Company, New York (1965); and *Printing Fundamentals*, A. Glassman, Ed., page 25TAPPI Press, Atlanta (1985). Trimetallic plates generally have a hydrophilic base layer of zinc, steel, stainless steel, aluminum, or the like that is electroplated first with copper (which is hydrophobic) and then with chromium (which is hydrophilic), as disclosed in, for example, *The Lithographer's Manual*, 7th Ed., R. N. Blair, ed., page 10:26, Graphic Arts Technical Foundation, Pittsburgh (1983).

The base material is capable of supporting good quality photomechanical coatings to be used in the lithographic process. The need for good dimensional stability increases as the size of the plate and the quality and registration requirements increase.

To the base layer is applied a layer of a photohardenable material capable of becoming hardened upon exposure to light. Generally, hardening occurs upon exposure to light within the ultraviolet wavelength region, although materials capable of becoming hardened by exposure to radiation in other wavelength ranges, such as visible light, are also suitable. By "hardenable" is meant that the material undergoes a change upon exposure to light that alters its solubility characteristics in at least one solvent, so that material exposed to light is not soluble in the solvent, whereas material that has not been exposed to light can be dissolved in the same solvent. Many photohardenable materials are known in the printing art and are suitable for use in the present invention. Examples of suitable photohardenable materials include materials such as gelatin, glue, gum arabic, synthetic polymers, or the like sensitized with materials such as diazo compounds, aromatic azido compounds, dichromates, or the like; photopolymers which become crosslinked upon exposure to incident radiation, generally in the presence of photoinitiators, such as polyesters such as polycarboxylates, polycarbonates, polysulfonates, or cinnamic acid esters, including those of epoxy resins modified with hydrocarbons, amines, nitro compounds, ketones, quinones, or other organic compounds; and the like. Preferred materials include the sensitizer N-(4'-methylbenzenesulfonyl)-imino-2,5-diethoxybenzoquinone-(1,4)-diazide-4 dispersed in polyacrylic acid; the sensitizer Diazon-9 (available from Molecular Rearrangement, Inc., Newton, NJ) dispersed in polyvinyl butyral; polyterpenes such as Nirez 1085, 1100, 1115, 1125, and 1135 (available from Reichhold Chemicals, Pensacola, FL); α-methyl styrene-vinyl toluene copolymers such as Piccotex 15, 100, 120, and LC (available from Hercules, Inc., Wilmington, DE); modified terpene hydrocarbon resins such as Zonatac 85, 105, and 115 (available from Arizona Chemical Company, Wade, NJ); polyterpene resins such as Zonarez 7055, 7070, 7085, 7100, 7115, and 7125 (available from Arizona Chemical Company, Wade, NJ); polyvinyl butyral doped with sensitizers such as the diazonium compounds of 4-amino-1(N-methyl-6-naphthalene-tetrahydride-1,2,3,4)-aminobenzene, 4'',4'''-diamino-2'',2'''-disulfo-1'',1'''-N,N-diphenyl-4,4'-diamino-1,1'-diphenyl, 4''-amino-2''-carboxyl-1''-N-phenyl-4,4'-diamino-1,1'-diphenylmethane, or the like; vinyl alkyl ether/maleic anhydride copolymers doped with a diazonium compound such as 4-amino-2,5-diethoxy benzenediazonium chloride, polyacrylic acid, polymethacrylic acid containing a diphenylamine-4-diazonium chloride such as 4'-bromodiphenylamine-4-diazonium chloride, or containing 2-methoxycarbazole-3-diazonium bromide; polyvinyl alcohol containing diazonium metal double salts of o-methoxy-p-aminodiphenylamine and the tetrazonium metal double salts of 1,1'-diethylbenzidene, o,o'-dimethylbenzidine, and dianisidine; polyacrylamide or copolymers of acrylic acid and acrylonitrile doped with aromatic azido compounds such as 4'-azido-4-azidobenzalacetophenone-2-sulfonic acid or 4-azidobenzalacetophenone-2-sulfonic acid; butadiene copolymers sensitized with aryl azido compounds such as p-azidobenzophenone and 4,4'-diazidobenzophenone; vinyl/maleic acid copolymers doped with p-quinone diazides such as benzoquinone-(1,4)-diazide-(4)-2-sulfonic acid-β-naphthylamide; polyacrylic acid or polymethacrylic acid doped with aminoquinone diazides such as N-(4'-methyl-benzenesulfonyl)-imino-2,5-diethoxybenzoquinone-(1,4)-diazide-4; and the like. Particularly preferred photohardenable materials also include photopolymers because of their relatively long shelf life, relative insensitivity to temperature and humidity, excellent abrasion resistance, and long run life.

Photohardenable materials are widely used in conventional printing plates. Additional information concerning printing plates and printing processes, including the use of photohardenable materials as printing plate components, is disclosed in, for example, *The Lithographers Manual*, 7th Edition, R. N. Blair, Ed., pages 10:1 to 10:34, Graphic Arts Technical Foundation, Pittsburgh, PA (1983); *Light-Sensitive Systems: Chemistry and Application of Nonsilver Halide Photographic Processes*, J. Kosar, pages 321 to 357, John Wiley & Sons, New York (1965); *The Printing Industry*, V. Strauss, pages 259 to 268, Printing Industries of America, New York (1967); *Photographic Systems for Engineers*, F. M. Brown et al., Eds., pages 10 to 13, Society of Photographic Scientists and Engineers, Washington, DC (1966); and *Printing Fundamentals*, A. Glassman, Ed., pages 23 to 36, TAPPI Press, Atlanta (1985), the disclosures of each of which are totally incorporated herein by reference. In addition, further information concerning printing plates, printing processes, and photohardenable materials is disclosed in, for example, U.S. Pat. No. 3,030,208, U.S. Pat. No. 3,453,237, U.S. Pat. No. 3,622,320, U.S. Pat. No. 2,791,504, U.S. Pat. No. 3,860,426, U.S. Pat. No. 4,777,115, U.S. Pat. No. 4,758,500, U.S. Pat. No. 4,816,379, U.S. Pat. No. 4,822,723, U.S. Pat. No. 3,175,906, U.S. Pat. No. 3,046,118, U.S. Pat. No. 2,063,631, U.S. Pat. No. 2,667,415, U.S. Pat. No. 3,867,147, U.S. Pat. No. 3,679,419, U.S. Pat. No. 4,828,963, U.S. Pat. No. 4,830,953, U.S. Pat. No. 4,423,135, U.S. Pat. No. 4,369,246, U.S. Pat. No. 4,323,637, U.S. Pat. No. 4,323,636, U.S. Pat. No. 2,714,066, U.S. Pat. No. 2,826,501, U.S. Pat. No. 4,859,551, and U.S. Pat. No. 2,649,373, the disclosures of each of which are totally incorporated herein by reference.

In addition to photohardenable materials, which are negative working (provide a negative image of the original), photodegradable materials may also be used, which are positive working (provide a positive image of the original). The layer of photohardenable or photodegradable material is of an effective thickness, generally from about 0.1 to about 500 microns, altough the thickness can be outside of this range.

To the surface of the photohardenable layer is applied a layer of softenable material containing migration marking material. The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. Patents directed to migration imaging members which have been incorporated herein by reference. The softenable layer can be of any effective thickness, generally from about 1 micron to about 30 microns, and preferably from about 2 microns to about 25 microns. The softenable layer can be applied to the photohardenable layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or possess any other desired physical property and still be suitable for use in the present invention. Preferably, the migration marking materials are particulate and closely spaced from each other. The preferred migration marking materials are generally spherical in shape and submicron in size. Generally, the migration marking material is capable of substantial photoconduction upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the base layer, although the migration marking material can also be dispersed throughout the softenable layer. When present as particles, the particles of migration marking material preferably have an average diameter of up to 2 micrometers, and more preferably of from about 0.1 micrometer to about 1 micrometer. The layer of migration marking particles is situated at or near that surface of the softenable layer spaced from or most distant from the base layer. Preferably, the particles are situated at a distance of from about 0.01 micrometer to 0.1 micrometer from the layer surface, and more preferably from about 0.02 micrometer to 0.08 micrometer from the layer surface. Preferably, the particles are situated at a distance of from about 0.005 micrometer to about 0.2 micrometer from each other, and more preferably at a distance of from about 0.05 micrometer to about 0.1 micrometer from each other, the distance being measured between the closest edges of the particles, i.e. from outer diameter to outer diameter. The migration marking material contiguous to the outer surface of the softenable layer is present in an effective amount, preferably from about 5 percent to about 25 percent by total weight of the softenable layer, and more preferably from about 10 to about 20 percent by total weight of the softenable layer.

Examples of suitable migration marking materials include selenium, alloys of selenium with alloying components such as tellurium, arsenic, mixtures thereof, and the like, phthalocyanines, and any other suitable materials as disclosed, for example, in U.S. Pat. No. 3,975,195 and other U.S. Patents directed to migration imaging members and incorporated herein by reference.

The migration marking particles can be included in the softenable layer by any suitable technique. For example, a layer of migration marking particles can be placed at or just below the surface of the softenable layer by coating the photopolymeric layer with the softenable layer material by any suitable technique, such as solution coating, followed by heating the softenable material in a vacuum chamber to soften it while at the same time thermally evaporating the migration marking material onto the softenable material in a vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference. When applying the softenable layer, care should be taken not to affect adversely the underlying photohardenable or photodegradable layer. During coating and handling, the underlying layer should not be exposed to light or heat for unnecessarily long periods, since light or heat may cause the photohardening or photodegradation to occur prematurely. Further information concerning the structure, materials, and preparation of migration imaging members is disclosed in U.S. Pat. No. 3,975,195, U.S. Pat. No. 3,909,262, U.S. Pat. No. 4,536,457, U.S. Pat. No. 4,536,458, U.S. Pat. No. 4,013,462, U.S. Pat. No. 4,853,307, U.S. Pat. No. 4,880,715, U.S. Pat. No. 4,883,731, U.S. application Ser. No. 590,959 (abandoned, filed 10/31/66), U.S. application Ser. No. 695,214 (abandoned, filed 1/2/68), U.S. application Ser. No. 000,172 (abandoned, filed 1/2/70), P. S. Vincett, G. J. Kovacs, M. C. Tam, A. L. Pundsack, and P. H. Soden, Migration Imaging Mechanisms, Exploitation, and Future Prospects of Unique Photographic Technologies, XDM and AMEN, Journal of Imaging Science 30 (4) Jul/Aug, pp. 183–191 (1986), G. J. Kovacs and P. S. Vincett, An Instant, Dry, Updaqtable Infrared Film With High Sensitivity and Resolution, J. Imaging Technology, vol. 12, no. 1, pages 17 to 24 (1986), and G. J. Kovacs and P. S. Vincett, "Subsurface Particle Monolayer and Film Formation in Softenable Substrates: Techniques and Thermodynamic Criteria," Thin Solid Films, vol. 111, pages 65 to 81 (1984), the disclosures of each of which are totally incorporated herein by reference.

If desired, a charge blocking layer can be situated between the base layer and the layer of softenable material. The optional charge blocking layer can be of any suitable blocking material. Examples of suitable materials include polyisobutyl methacrylate, copolymers of styrene and acrylates such as styrene/n-butyl methacrylate, copolymers of styrene and vinyl toluene, polycarbonates, alkyd substituted polystrenes, styreneolefin copolymers, polyesters, polyurethanes, polyterpenes, silicone elastomers, mixtures thereof, copolymers thereof, and the like. The charge blocking layer can be of any effective thickness, typically from about 0.01 micron to about 10 microns and preferably from about 1 micron to about 2 microns, although the thickness can be outside of this range.

Further, if desired, a charge transport material can be situated either in the softenable material, in the optional blocking layer, in a separate charge transport layer, or the like. Examples of suitable charge transport materials are disclosed in, for example, U.S. Pat. No. 4,306,008, U.S. Pat. No. 4,304,829, U.S. Pat. No. 4,233,384, U.S. Pat. No. 4,115,116, U.S. Pat. No. 4,299,897, U.S. Pat. No. 4,081,274, U.S. Pat. No. 4,315,982, U.S. Pat. No. 4,278,746, U.S. Pat. No. 3,837,851, U.S. Pat. No. 4,245,021, German Patent 1,058,836, German Patent 1,060,260, German Patent 1,120,875, U.S. Pat. No. 4,150,987, U.S. Pat. No. 4,385,106, U.S. Pat. No. 3,972,717, U.S. Pat. No. 3,870,516, U.S. Pat. No. 3,895,944, U.S. Pat. No. 3,820,989, U.S. Pat. No. 4,474,865, U.S. Pat. No. 4,338,388, U.S. Pat. No. 4,387,147, U.S. Pat. No. 4,256,821, U.S. Pat. No. 4,536,458, and U.S. Pat. No. 4,297,426, the disclosures of each of which are totally incorporated herein by reference. The charge transport material is present in a particular layer in an effective amount, typically from about 2 to about 50 percent by weight, although the amount can be outside of this range.

Optionally, a protective overcoating layer can be situated on the surface of the softenable layer. The overcoating preferably is substantially transparent, at least in the spectral region where electromagnetic radiation is used for imagewise exposure step in the image formation process and for the uniform exposure step in the plate making process. The overcoating layer is continuous and preferably of a thickness up to about 1 to 2 micrometers. Overcoating layers greater than about 1 to 2 micrometers thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling. The overcoating layer preferably adheres strongly to the softenable layer to minimize damage.

If an optional overcoating layer is used on top of the softenable layer to improve abrasion resistance and if solvent softening is employed to effect migration of the migration marking material through the softenable material, the overcoating layer should be permeable to the vapor of the solvent used and additional vapor treatment time should be allowed so that the solvent vapor can soften the softenable layer sufficiently to allow the light-exposed migration marking material to migrate towards the base layer in image configuration. Solvent permeability is unnecessary for an overcoating layer if heat is employed to soften the softenable layer sufficiently to allow the exposed migration marking material to migrate towards the base layer in image configuration.

Further information concerning the structure, materials, and preparation of softenable layers containing migration marking material is disclosed in U.S. Pat. No. 3,975,195, U.S. Pat. No. 3,909,262, U.S. Pat. No. 4,536,457, U.S. Pat. No. 4,536,458, U.S. Pat. No. 4,013,462, U.S. Pat. No. 4,101,321, U.S. Pat. No. 3,468,607, U.S. Pat. No. 3,820,984, U.S. Pat. No.

4,883,731, U.S. Pat. No. 4,853,307, U.S. Pat. No. 4,880,715, U.S. application Ser. No. 590,959 (abandoned, filed 10/31/66), U.S. application Ser. No. 695,214 (abandoned, filed 1/2/68), U.S. application Ser. No. 000,172 (abandoned, filed 1/2/70), and P. S. Vincett, G. J. Kovacs, M. C. Tam, A. L. Pundsack, and P. H. Soden, Migration Imaging Mechanisms, Exploitation, and Future Propects of Unique Photographic Technologies, XDM and AMEN, Journal of Imaging Science 30 (4) Jul/Aug, pp. 183–191 (1986), the disclosures of each of which are totally incorporated herein by reference.

In a specific embodiment of the present invention, the printing plate precursor comprises a base layer and a layer of a softenable photohardenable material containing migration marking material. In this embodiment, instead of comprising separate contiguous layers, the photohardenable material and the softenable material are contained in a single layer, which comprises a material having both softenable and photohardenable characteristics. The photohardenable material is capable of becoming hardened upon exposure to light, such as ultraviolet radiation, and is also capable of being softened to enable migration marking material to migrate through the layer of photohardenable material toward the base layer. Further, if the final printing plate is to consist of the exposed base layer and the photohardened material in image configuration, the photohardenable material is either hydrophobic or hydrophilic, depending on the printing process to be employed with the plate. After the unhardened material has been removed after development of the imaged precursor, the hardened material has the opposite hydrophilicity to the exposed base plate material, so that the difference in surface chemistry properties between the base layer material and the photohardened material can be employed to print an image. The photohardenable material need not process a hydrophilicity opposite to that of the base layer material when the photohardenable material is ultimately removed after functioning as a mask or stencil for producing a deep-etched plate or a bimetallic plate.

Generally, it is preferred that the photohardenable material is not sensitive to radiation in the wavelength range at which the printing plate precursor is initially exposed for the purpose of causing the migration marking material to migrate in imagewise fashion. For example, in one embodiment, the migration marking material photodischarges upon exposure to visible light and the photohardenable material does not harden upon exposure to visible light. Thus, the printing plate precursor will first be exposed to visible light to cause the migration marking material to migrate in imagewise fashion, followed by exposure of the plate precursor to ultraviolet light to cause the photohardenable material to harden in exposed areas. However, the photohardenable material can be sensitive to radiation at the same wavelengths employed to expose the migration marking material in the softenable layer. The sensitivity of the migration marking material to light generally is far greater than the sensitivity of the photohardenable material to light; thus, exposure of the migration marking material would not be expected to result in significant photohardening of the photohardenable material if both materials are sensitive to the same wavelengths. Further, the exposed areas of the migration marking material in the softenable layer typically correspond to the areas on the photohardenable layer to be ultimately exposed to light and hardened, so that any premature photohardening that occurs during exposure of the migration marking material would not be expected to be detrimental to the finished plate.

Examples of softenable photohardenable materials include polyterpenes such as Nirez 1085, 1100, 1115, 1125, and 1135 (available from Reichhold Chemicals, Pensacola, FL); α-methyl styrene-vinyl toluene copolymers such as Piccotex 15, 100, 120, and LC (available from Hercules, Inc., Wilmington, DE); modified terpene hydrocarbon resins such as Zonatac 85, 105, and 115 (available from Arizona Chemical Company, Wade, NJ); polyterpene resins such as Zonarez 7055, 7070, 7085, 7100, 7115, and 7125 (available from Arizona Chemical Company, Wade, NJ); polyvinyl butyral doped with sensitizers such as 4-amino-1(N-methyl-6-naphthalene-tetrahydride-1,2,3,4)-aminobenzene, 4″,4‴-diamino-2″,2‴-disulfo-1″,1‴-N,N-diphenyl-4,4′-diamino-1,1′-diphenyl, 4″-amino-2″-carboxyl-1″-N-phenyl-4,4′-diamino-1,1′-diphenyl-methane, or the like; vinyl alkyl ether/maleic anhydride copolymers doped with a diazonium compound such as 4-amino-2,5-diethoxy benzenediazonium chloride, polyacrylic acid, polymethacrylic acid containing a diphenylamine-4-diazonium chloride such as 4′-bromodiphenylamine-4-diazonium chloride, or containing 2-methoxycarbazole-3-diazonium bromide; polyvinyl alcohol containing diazonium metal double salts of o-methoxy-p-aminodiphenylamine and the tetrazonium metal double salts of 1,1′-diethylbenzidene, o,o′-dimethylbenzidine, and dianisidine; polyacrylamide or copolymers of acrylic acid and acrylonitrile doped with aromatic azido compounds such as 4′-azido-4-azidobenzalacetophenone-2-sulfonic acid or 4-azidobenzalacetophenone-2-sulfonic acid; butadiene copolymers sensitized with aryl azido compounds such as p-azidobenzophenone and 4,4′-diazidobenzophenone; vinyl/maleic acid copolymers doped with p-quinone diazides such as benzoquinone-(1,4)-diazide-(4)-2-sulfonic acid-β-naphthylamide; polyacrylic acid or polymethacrylic acid doped with aminoquinone diazides such as N-(4′-methyl-benzenesulfonyl)-imino-2,5-diethoxybenzoquinone-(1,4)-diazide-4; and the like. The migration marking material is included in the softenable photohardenable layer by any suitable process as detailed previously herein. Subsequent to formation of a printing plate with this specific precursor, the hardened polymer remaining on the base layer contains migrated migration marking material.

Figure 2:
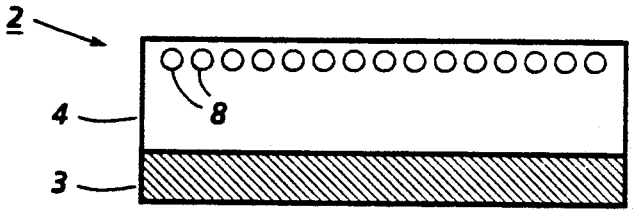
FIG. 2 illustrates schematically another embodiment of a printing plate precursor of the present invention.

An example of this embodiment is illustrated schematically in FIG. 2. As shown in FIG. 2, printing plate precursor 2 comprises a base layer 3 and a layer comprising a softenable photohardenable material 4 situated on base layer 3, said softenable photohardenable material containing migration marking material 8. The specific embodiment of the precursor illustrated in FIG. 2 can also contain an optional overcoating layer (not shown) or other optional layers such as those described herein.

A printing plate precursor of the present invention is used to prepare a printing plate by first exposing and developing the softenable layer containing migration marking material to form an in situ mask corresponding to the image desired for the printing plate. Subsequently, the precursor is exposed to light through the mask thus formed to harden the photohardenable material in exposed areas, followed by washing away the softenable material and the unhardened photohardenable material to form the printing plate with hardened photohardenable material in image configuration on the base layer. The process of preparing the printing plate from the precursor is illustrated schematically in FIGS. 3 through 7.

Figure 3:
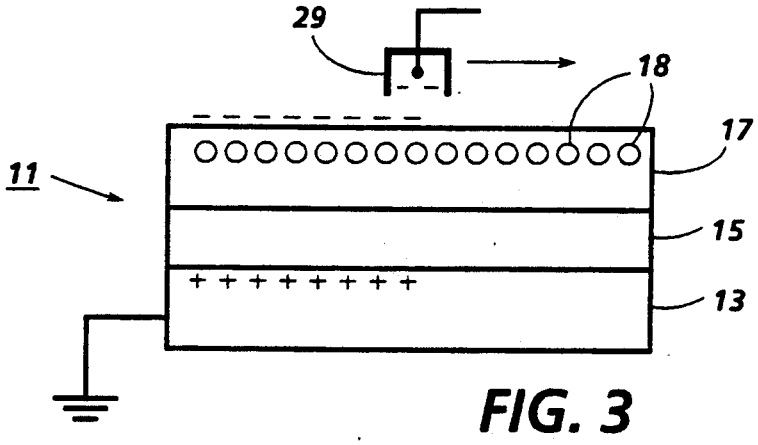
FIGS. 3 through 7 illustrate schematically a process for preparing a printing plate according to the present invention The Figures are schematic and are not intended to illustrate scale or relative proportions.
Figure 4:
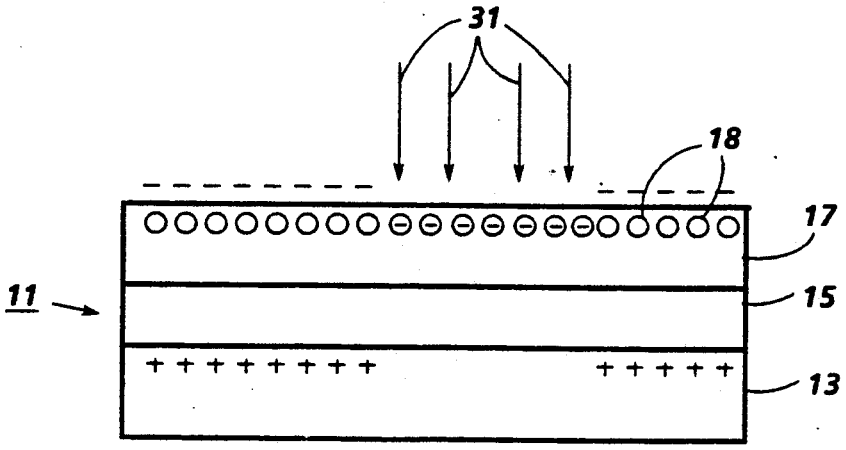

As illustrated schematically in FIG. 3, a printing plate precursor 11 comprising a conductive base layer 13, layer of photohardenable material 15, and softenable material 17 containing migration marking material 18 is uniformly charged on the surface having the layer of softenable material 17 containing migration marking material 18 to either positive or negative polarity (negative charging is illustrated in the Figure) by a charging means 29, such as a corona charging apparatus. Subsequently, as illustrated schematically in FIG. 4, the charged plate is exposed imagewise to activating radiation 31, such as light, prior to substantial dark decay of the uniform charge on the surface of the softenable layer 17, thereby forming an electrostatic latent image thereon. Preferably, exposure to activating radiation is prior to the time when the uniform charge has undergone dark decay to a value of less than 50 percent of the initial charge, although exposure can be subsequent to this time provided that the objectives of the present invention are achieved.

Figure 5:
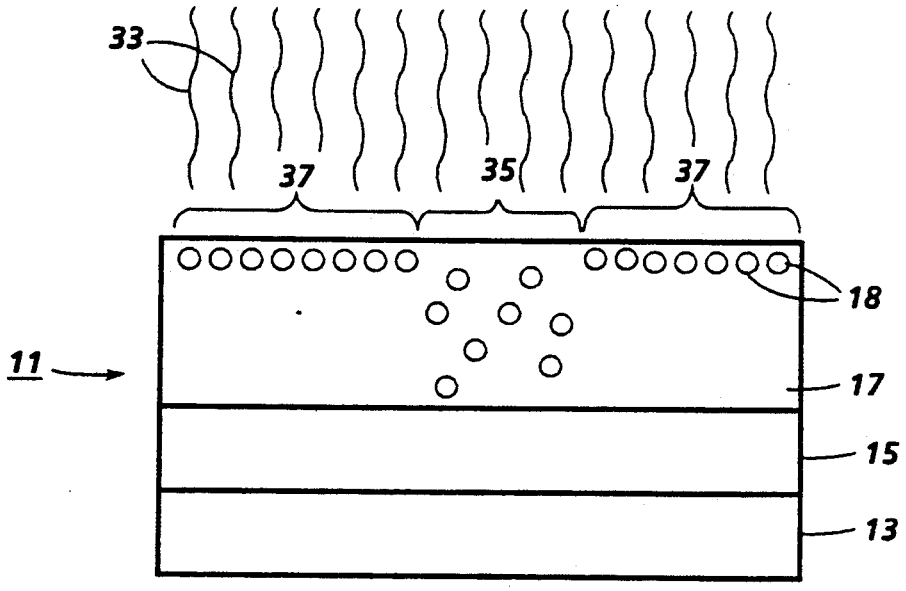

As illustrated schematically in FIG. 5, subsequent to imagewise exposure to form a latent image, the imaging member is developed by causing the softenable material to soften by any suitable means (in FIG. 5, by uniform application of heat energy 33 to the softenable layer 17). The heat development temperature and time depend upon factors such as the how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 17 decreases in viscosity, thereby decreasing its resistance to migration of the marking material 18 through the softenable material. In the exposed areas 35 of the softenable layer, the migration marking material 18 gains a substantial net charge which, upon softening of the softenable material 17, causes the exposed marking material to migrate in image configuration towards the base layer 13 and disperse in the softenable layer 17, resulting in a $D_{min}$ area. The unexposed migration marking particles 18 in the unexposed areas 37 of the softenable layer remain essentially neutral and uncharged. Thus, in the absence of migration force, the unexposed migration marking particles remain substantially in their original position in softenable layer 17, resulting in a $D_{max}$ area. Thus, as illustrated in FIG. 5, the developed image is an optically sign-retaining visible image of an original (if a conventional light-lens exposure system is utilized). Exposure can also be by means other than light-lens systems, including raster output scanning devices such as laser writers. Exposure energies generally need not exceed those typically employed for camera-type exposures of silver halide films, and for selenium migration marking materials, exposures at the level of about 10 ergs per square centimeter are typical.

If desired, solvent vapor development can be substituted for heat development. Vapor development of migration imaging members is well known in the art. Generally, if solvent vapor softening is utilized, the solvent vapor exposure time depends upon factors such as the solubility of softenable layer in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable material of softenable layer 17 to allow migration of the migration marking material 18 through softenable layer 17 in imagewise configuration. With heat development, satisfactory results can be achieved by heating the imaging member to a temperature of about 100° C. to about 130° C. for only a few seconds when the unovercoated softenable layer contains a custom synthesized 80/20 mole percent copolymer of styrene and hexylmethacrylate having an intrinsic viscosity of 0.179 deciliter per gram. With vapor development, satisfactory results can be achieved by exposing the softenable layer to the vapor of toluene for between about 4 seconds and about 60 seconds at a solvent vapor partial pressure of between about 5 millimeters and 30 millimeters of mercury when the unovercoated softenable layer contains a custom synthesized 80/20 mole percent copolymer of styrene and hexylmethacrylate having an intrinsic viscosity of 0.179 deciliter per gram.

For embodiments of the present invention wherein the precursor comprises a base layer and a layer of softenable photohardenable material containing migration marking material, a development technique wherein the migration marking material migrates to near the base layer, such as for example vapor development techniques with vapors such as toluene, trichloroethylene, 1,1,1-trichloroethane, methyl ethyl ketone, dichloromethane, or the like, may be preferred in some instances to allow the full thickness of the softenable layer to become photohardened, since the softenable photohardenable material would virtually all be above the migration marking particles in image areas subsequent to migration. If the particles were dispersed through the softenable layer, the softenable material above them could become photohardened, but the softenable material below the particles would be shielded from photohardening radiation and would remain soft and soluble. When the migration marking particles are sufficiently small in diameter to allow light scattering effects to expose the underlying photohardenable material, however, the aforementioned difficulties will most likely not arise.

The printing plate precursor having an imaged softenable layer shown in FIG. 5 is transmitting to light in the exposed region because of the depthwise migration and dispersion of the migration marking material in the exposed region. The $D_{max}$ in the unexposed region generally is essentially the same as the original unprocessed softenable layer because the positions of migration marking particles in the unexposed regions remain essentially unchanged. Thus, optically sign-retained visible images with high optical contrast density in the region of 0.9 to 1.2 can be achieved. In addition, exceptional resolution, such as 228 line pairs per millimeter, can be achieved on the imaged softenable layer. The imaged softenable layer of the printing plate precursor as illustrated in FIG. 5 functions as an in-situ mask for subsequent flood exposure to light of the photohardenable material.

Figure 6:
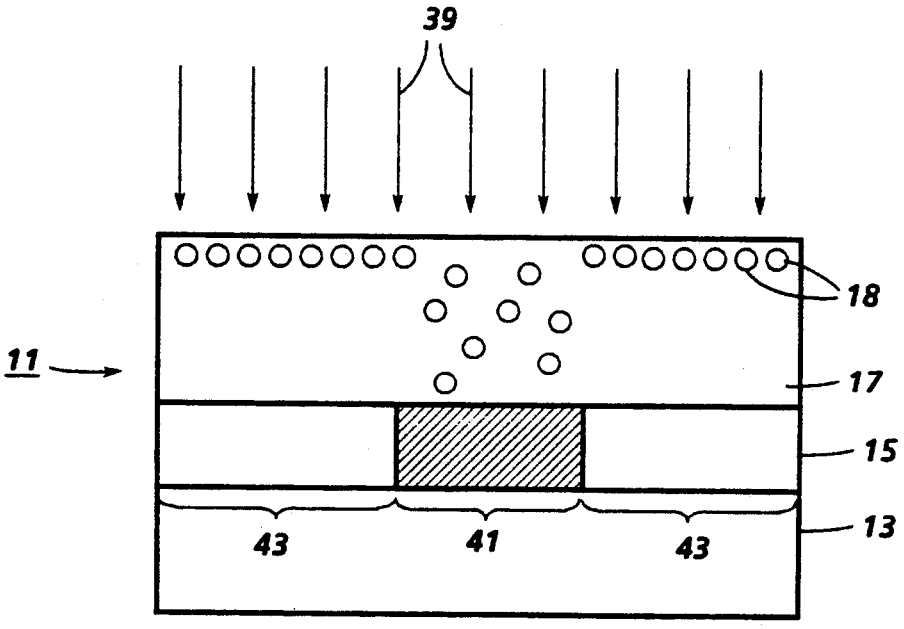
Figure 7:
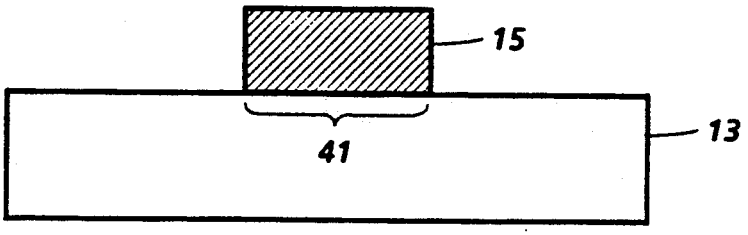

As illustrated schematically in FIG. 6, the printing plate precursor with the imaged softenable layer 17 is then exposed to light 39 at a wavelength capable of causing the photohardenable material to harden in areas exposed to light through the in situ mask. Typically, photohardenable materials employed in conventional printing plates can become hardened by exposure to light in the ultraviolet wavelength region, although photohardenable materials that harden upon exposure to energy in other wavelength regions can also be selected. Exposure of the photohardenable material is for any length of time and at any level of incident radiation sufficient to cause hardening of the photohardenable material. For example, photohardenable materials frequently employed for conventional printing plates, such as Azoplate (available from Hoechst), KPR (available from Eastman Kodak Company), or the like, typically can be hardened by exposure to ultraviolet light through the mask of the imaged softenable layer at an exposure level of from about $10^3$ to about $10^6$ ergs per square centimeter for a time period of from about 30 to about 180 seconds. Exposure of photohardenable material 15 results in exposed areas 41 becoming hardened and unexposed areas 43 remaining unhardened. Any suitable source of radiation can be employed, such as carbon arc lamps, mercury vapor lamps, fluorescent lamps, tungsten lamps, photoflood lamps, or the like.

Subsequently, the exposed printing plate precursor is washed with a solvent in which the softenable material and the unhardened photohardenable material are relatively soluble and in which the hardened photohardenable material is relatively insoluble. Examples of suitable solvents include water, isopropyl alcohol, normal propyl alcohol, Cellosolve (ethylene glycol monoethyl ether), butyl alcohol, benzyl alcohol, solutions of aromatic sulfonic acids and their salts, acetone, methanol, methyl ethyl ketone, benzene, toluene, xylene, carbon tetrachloride, trichloroethane, trichloroethylene, methylchloroform, tetrachloroethylene, and the like as well as mixtures thereof. As illustrated schematically in FIG. 7, washing the plate precursor results in removal from the base layer 13 of all unhardened photohardenable material and all softenable material, resulting in formation of a printing plate comprising base layer 13 having thereon hardened photohardenable material 15 in imagewise configuration in areas 41 previously exposed to light. The washing step is well known in the printing art. Further information regarding development of an exposed printing plate by washing is disclosed in, for example, U.S. Pat. No. 3,860,426, U.S. Pat. No. 4,780,396, U.S. Pat. No. 4,822,723, and U.S. Pat. No. 4,423,135, the disclosures of each of which are totally incorporated herein by reference.

The printing plate thus formed can be employed in known printing processes. For example, since the base layer typically is hydrophilic and the hardened photohardenable material typically is hydrophobic, an oil-based hydrophobic ink applied to the plate will adhere to the photohardenable material and be repelled by the base layer. The ink thus applied can be transferred directly to a printing substrate such as paper, cloth, or the like in image configuration by contacting the printing substrate directly to the plate. Alternatively, the ink can be transferred in image configuration to an intermediate transfer means, such as a roller, belt, sheet, or the like, as typically is done in lithographic processes, and the ink image can then be transferred from the intermediate transfer means to a printing substrate by contacting the intermediate transfer means to the substrate.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLES I

A roll of 5 mil thick aluminum sheet 12.5 inches wide by 30 feet long is first treated to prevent reaction with diazo coatings and then hand coated in sections. The pretreatment of the aluminum is carried out by first passing the aluminum through a degreasing bath of trichloroethylene, followed by passing the aluminum through an aqueous solution containing 5 percent sodium phosphate, 5 percent sodium silicate, and 5 percent sodium metaborate which is maintained at 180° F. to 212° F. The silicate treatment imparts to the aluminum a permanently hydrophilic silicone surface. The silicate coating is then hardened by passing the aluminum through a 10 percent solution of citric acid, which neutralizes any remaining alkali in the silicate coating. Thereafter, the aluminum is passed through a warm water rinse to wash away excess soluble silicate and is then dried and wound into a roll.

Subsequently, a photohardenable layer is applied to the aluminum base layer onto unrolled sections of the rolled up aluminum. The photohardenable material is N-(4'-methyl-benzenesulfonyl)-imino-2,5-diethoxybenzoquinone-(1,4)-diazide-4, having the following formula:

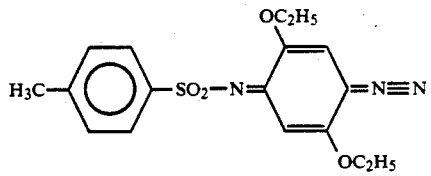

dispersed in polyacrylic acid (available from Scientific Polymer Products, Inc., Ontario, NY). The iminodiazide is prepared according to the method described in U.S. Pat. No. 2,759,817, the disclosure of which is totally incorporated herein by reference, at column 11, lines 22 to 48. The photohardenable mixture of polyacrylic acid and iminodiazide contains 50 percent by weight iminodiazide and 50 percent by weight polyacrylic acid, and is co-dissolved in glylcolmonomethylether, with the total solids content being 2 percent by weight. This solution is then hand coated with a No. 30 Meyer rod about 1 foot long onto the aluminum sheet and dried to form a film of a thickness of 5 microns.

Thereafter, a terpolymer of styrene, ethyl acrylate, and acrylic acid (E-335, available from DeSoto, Inc.) is added to toluene in an amount sufficient to result in a 10 percent solids solution. This mixture is then coated onto the polyacrylic acid/iminodiazide layer by hand coating with a No. 14 Meyer rod, followed by drying to form a layer of a thickness of 2 microns.

Additional two layered coatings of polyacrylic acid/iminodiazide and styrene, ethyl acrylate, and acrylic acid terpolymer are subsequently applied to the aluminum sheet adjacent to the first two-layered coating.

Subsequently, the coated aluminum base plate is inserted into a selenium vacuum roll coater and the chamber is brought to a pressure of $1\times10^{-5}$ torr. The vacuum coater is described in, for example, A. L. Pundsack, P. S. Vincett, P. H. Soden, M. C. Tam, G. J. Kovacs, and D. S. Ng, J. Imaging Technology, vol. 10, no. 5, pages 190 to 196(1984), the disclosure of which is totally incorporated herein by reference. Selenium is then evaporated onto the terpolymer layers of the moving coated substrate in an amount of 55 micrograms per square centimeter. During the coating process, the coated aluminum structure is heated to a temperature of 110° C. by a hot roll as it passes over the selenium source, and a monolayer of selenium particles with a diameter of about 0.3 micron is formed just below the surface of the softenable styrene, ethyl acrylate, and acrylic acid terpolymer layer.

A sheet of the aluminum base layer coated with the softenable photohardenable material and the monolayer of selenium is then cut from the roll to a size corresponding to that of an A3 piece of paper. The layered sheet structure has a thickness of 7 microns. Thereafter, the layered structure is first charged in the dark by corona charginhg techniques to about −700 volts and then contact exposed through a negative silver halide target with light at 440 nm for 10 seconds (total energy about 10 ergs per square centimeter). The exposed structure is then heated on a heat block at 110° C. for 10 seconds, resulting in the selenium particles migrating and dispersing in depth in the softenable terpolymer material in exposed areas and remaining in monolayer configuration in unexposed areas.

Photohardening of the polyacrylic acid/iminodiazide photohardenable material is then accomplished by uniformly exposing the layered structure to ultraviolet radiation from a high pressure mercury lamp to apply a total energy of $10^6$ ergs per square centimeter of ultraviolet radiation. The areas under the selenium monolayer regions remain unhardened, and the areas under the migrated selenium particles become photohardened. The ultraviolet light exposure transforms the mixture into oleophilic products insoluble in dilute alkalis, acids, and organic solvents. The primary reaction taking place during exposure to light can be illustrated by the following equation:

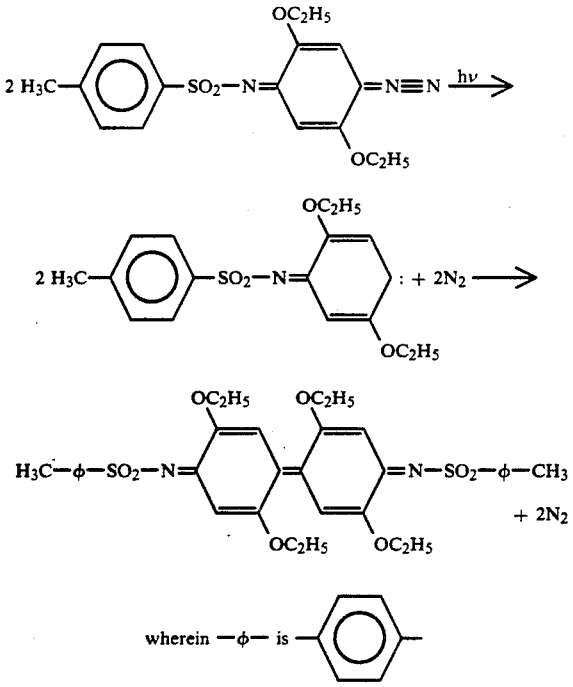

The reactive species formed upon ultraviolet exposure dimerizes to form an insoluble product.

The plate is then developed by wiping with a cloth soaked in acetone, which entirely removes the softenable terpolymer layer and most of the unhardened parts of the polyacrylic acid layer. Subsequently, the plate is wiped with a cloth soaked in water, which cleanses the plate and also removes the remaining unhardened photohardenable material, leaving the hydrophobic photohardened polyacrylic acid/iminodiazide mixture remaining in imagewise configuration on the plate and the hydrophilic exposed aluminum in all other areas of the plate.

Thereafter, the A3 sized plate is loaded without further treatment onto a single stage Heidelberg GTU press and several impressions are run on A3 size cut sheet paper using a black oil based lithographic ink available from Canadian Fine Colour Company, Ltd., Toronto, Ontario (black member of the PQ (Premium Quality) series of offset lithographic inks). It is expected that high contrast density prints with clear background areas will be obtained.

EXAMPLE II

A roll of 5 mil thick aluminum sheet 12.5 inches wide by 30 feet long is first treated to prevent reaction with diazo coatings and then hand coated in sections. The pretreatment of the aluminum is carried out by first passing the aluminum through a degreasing bath of trichloroethylene, followed by passing the aluminum through an aqueous solution containing 5 percent sodium phosphate, 5 percent sodium silicate, and 5 percent sodium metaborate which is maintained at 180° F. to 212° F. The silicate treatment imparts to the aluminum a permanently hydrophilic silicone surface. The silicate coating is then hardened by passing the aluminum through a 10 percent solution of citric acid, which neutralizes any remaining alkali in the silicate coating. Thereafter, the aluminum is passed through a warm water rinse to wash away excess soluble silicate and is then dried and wound into a roll.

Subsequently, a photohardenable layer is applied to the aluminum base layer onto unrolled sections of the rolled up aluminum. The photohardenable material is polyvinyl butyral (B-73, available from Monsanto Plastics and Resins Company, St. Louis, MO) doped with Diazon-9, a solvent soluble negative sensitizer manufactured by Molecular Rearrangement, Inc., Newton, NJ. The photohardenable material contains 60 percent by weight of polyvinyl butyral and 40 percent by weight Diazon-9. The doped polyvinylbutyral is dissolved in methyl cellosolve (available from Union Carbide, Inc.), with the total solids content being 10 percent. This solution is then hand coated with a No. 14 Meyer rod onto the aluminum sheet and dried to form a film of a thickness of 2 microns.

Subsequently, the coated aluminum base plate is inserted into a selenium vacuum roll coater as described in Example I and the chamber is brought to a pressure of $1\times10^{-5}$ torr. Selenium is then evaporated onto the moving coated layers in an amount of 55 micrograms per square centimeter. During the coating process, the coated aluminum structure is heated to a temperature of 110° C. by a hot roll as it passes over the selenium source, and a monolayer of selenium particles with a diameter of about 0.3 microns is formed just below the surface of the doped polyvinyl butyral layer.

A sheet of the aluminum base layer coated with the softenable photohardenable material and the monolayer of selenium is then cut from the roll to a size corresponding to that of an A3 piece of paper. Thereafter, the layered structure is first charged in the dark by corona charging techniques to about +200 volts and then contact exposed through a negative silver halide target with light at 440 nm for 10 seconds (total energy about 10 ergs per square centimeter). The exposed structure is then exposed to methyl ethyl ketone vapor for 20 seconds at a solvent vapor partial pressure of 20 mm Hg, resulting in the selenium particles migrating in depth in the softenable material to near the base layer in exposed areas and remaining in monolayer configuration in unexposed areas.

Photohardening is then accomplished by uniformly exposing the structure to ultraviolet radiation from a high pressure mercury lamp to apply a total energy of $10^6$ ergs per square centimeter of ultraviolet radiation. The areas under the selenium monolayer regions remains unhardened, and the areas under the migrated selenium particles become photohardened. Crosslinking reactions occur to effect the photohardening. Diazon-9 is a polymeric material with the following structure:

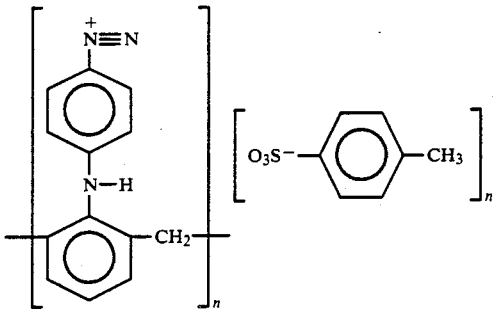

Polyvinyl butyral is made up of various proportions of butyral, alcohol, and acetate:

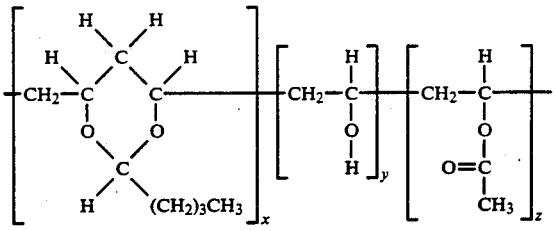

butyral alcohol acetate

If Diazon-9 is represented by the abbreviated notation $$-[(XN_2)^+Y^-]-$$

then on exposure to ultraviolet light, extremely reactive charged species are formed according to $$-[(XN_2)^+Y^-]- \xrightarrow{h\nu} -X-^+ + N_2 + Y^-$$

These reactive species induce crosslinking of the polyvinylbutyral. As an example, the alcohol groups can be crosslinked as follows:

$$-[(XN_2)^+Y^-]-[(XN_2)^+Y^-]- + 2\,[CH_2-CH_2(OH)] \xrightarrow{h\nu}$$

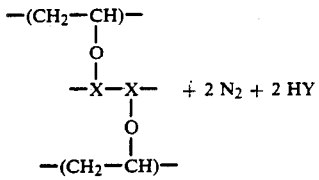

The plate is then developed by wiping with a cloth soaked in methyl cellosolve, which entirely removes the areas of the polyvinylbutyral coating having a monolayer of selenium particles near the surface and leaving behind in imagewise configuration the insoluble areas of the polyvinyl butyral in which the selenium particles have migrated. The photohardened polyvinyl butyral functions as the hydrophobic ink receptive areas of the plate and the exposed aluminum base layer function as the hydrophilic ink repellant areas of the plate.

Thereafter, the A3 sized plate is loaded without further treatment onto a single stage Heidelberg GTU press and several impressions are run on A3 size cut sheet paper using a black oil based lithographic inks described in Example I. It is believed that high contrast density prints with clear background areas will be obtained.

Other embodiments and modifications of the present invention may occur to those skilled in the art subsequent to a review of the information presented herein; these embodiments and modifications, as well as equivalents thereof, are also included within the scope of this invention.

What is claimed is:

1. A printing plate precursor which comprises a base layer, a layer of photohardenable material, and a layer of softenable material containing photosensitive migration marking material.

2. A printing plate precursor according to claim 1 wherein the base layer is electrically conductive.

3. A printing plate precursor according to claim 1 wherein the base layer is of a material selected from the group consisting of copper, brass, nickel, zinc, chromium, stainless steel, plastics, rubbers, aluminum, semi-transparent aluminum, steel, cadmium, silver, gold, indium, tin oxide, indium tin oxide, paper, glass, polyesters, and mixtures thereof.

4. A printing plate precursor according to claim 1 wherein the base layer is electrically insulating.

5. A printing plate precursor according to claim 1 wherein the base layer has a thickness of from about 0.25 to about 30 mils.

6. A printing plate precursor according to claim 1 wherein the softenable material is selected from the group consisting of styrene-acrylic copolymers, polystyrenes, polyesters, polyurethanes, polycarbonates, polyterpenes, silicone elastomers, and mixtures thereof.

7. A printing plate precursor according to claim 1 wherein the softenable material is selected from the group consisting of styrene-hexylmethacrylate copolymers, styrene acrylate copolymers, styrene butylmethacrylate copolymers, styrene butylacrylate ethylacrylate copolymers, styrene ethylacrylate acrylic acid copolymers, polyalphamethyl styrene, alkyd substituted polystyrenes, styrene-olefin copolymers, styrene-vinyltoluene copolymers, and mixtures thereof.

8. A printing plate precursor according to claim 1 wherein the layer of softenable material has a thickness of from about 1 to about 30 microns.

9. A printing plate precursor according to claim 1 wherein the migration marking material is selected from the group consisting of selenium, alloys of selenium with tellurium, alloys of selenium with arsenic, alloys of selenium with tellurium and arsenic, phthalocyanines, and mixtures thereof.

10. A printing plate precursor according to claim 1 wherein the migration marking material is present as a fracturable layer of particles situated contiguous to the surface of the softenable layer spaced apart from the base layer.

11. A printing plate precursor according to claim 1 wherein an overcoating layer is situated on the surface of the softenable layer spaced apart from the base layer.

12. A printing plate precursor which comprises a base layer and a layer of softenable photohardenable material containing photosensitive migration marking material.

13. A printing plate precursor according to claim 12 wherein the softenable photopolymeric material is selected from the group consisting of polyterpenes, α-methyl styrene-vinyl toluene copolymers, modified terpene hydrocarbon resins, polyvinyl butyral doped with sensitizers, vinyl alkyl ether/maleic anhydride copolymers doped with a diazonium compound, polyacrylic acid, polymethacrylic acid containing a diphenylamine-4-diazonium chloride, polymethacrylic acid containing 2-methoxycarbazole-3-diazonium bromide, polyvinyl alcohol containing diazonium metal double salts of o-methoxy-p-aminodiphenylamine and the tetrazonium metal double salts of 1,1'-diethylbenzidene, o,o'-dimethylbenzidine, and dianisidine, polyacrylamide doped with aromatic azido compounds, copolymers of acrylic acid and acrylonitrile doped with aromatic azido compounds, butadiene copolymers sensitized with aryl azido compounds, vinyl/maleic acid copolymers doped with p-quinone diazides, polyacrylic acid doped with aminoquinone diazides, polymethacrylic acid doped with aminoquinone diazides, and mixtures thereof.

14. A printing plate precursor according to claim 12 wherein the layer of softenable photohardenable material has a thickness of from about 1 to about 30 microns.

15. A printing plate precursor according to claim 12 wherein the layer of softenable photopolymeric material has a thickness of from about 0.1 to about 500 microns.

* * * * *